US007499380B2

(12) United States Patent
Gouthier et al.

(10) Patent No.: US 7,499,380 B2
(45) Date of Patent: Mar. 3, 2009

(54) DIAL

(75) Inventors: Christophe Gouthier, Le Locle (CH); Philippe Hubbard, Neuchâtel (CH)

(73) Assignee: ArteCad SA

( * ) Notice: Subject to any disclaimer, the term of this patent is extended or adjusted under 35 U.S.C. 154(b) by 275 days.

(21) Appl. No.: 10/811,845

(22) Filed: Mar. 30, 2004

(65) Prior Publication Data

US 2004/0196742 A1 Oct. 7, 2004

(30) Foreign Application Priority Data

Apr. 1, 2003 (CH) ..... 0561/2003

(51) Int. Cl.
*G04B 19/32* (2006.01)
*G04B 19/04* (2006.01)
*G04B 19/06* (2006.01)

(52) U.S. Cl. ..... 368/226; 368/228; 368/234

(58) Field of Classification Search ..... 368/226, 368/228, 232, 234, 223; 250/463.1
See application file for complete search history.

(56) References Cited

U.S. PATENT DOCUMENTS

| | | | | |
|---|---|---|---|---|
| 1,364,950 | A | 1/1921 | O'Hara | |
| 2,885,561 | A * | 5/1959 | Lange | 250/463.1 |
| 3,851,460 | A * | 12/1974 | Piquerez | 368/296 |
| 5,426,621 | A * | 6/1995 | Akasaka | 368/226 |
| 5,838,644 | A * | 11/1998 | Yoneda et al. | 368/232 |
| 6,113,726 | A | 9/2000 | Leschot | |

FOREIGN PATENT DOCUMENTS

| | | |
|---|---|---|
| EP | 0847 546 B1 | 8/1996 |
| FR | 612312 G | 10/1977 |

* cited by examiner

*Primary Examiner*—Anthony H Nguyen
*Assistant Examiner*—Leo T Hinze
(74) *Attorney, Agent, or Firm*—Blank Rome LLP

(57) ABSTRACT

Dial (2) designed to equip a watch piece provided with luminous marks (32) lodged under a mother-of-pearl semi-transparent layer (20) inside blind hollows (35) made in the semi-transparent layer (20) and filled with a phosphorescent pigment (32). The luminous marks (32) form an image (61) visible in darkness and essentially invisible in daylight.

20 Claims, 1 Drawing Sheet

DIAL

REFERENCE DATA

This patent application claims priority from Swiss patent application No 2003CH-0561 filed on Apr. 1, 2003.

FIELD OF THE INVENTION

The present invention concerns a dial for an instrument with an analog display and especially, but not exclusively, on a clock face designed to equip a wristwatch.

DESCRIPTION OF RELATED ART

It is known to apply luminous indexes to a clock face to allow the time to be read in the dark. These indexes can take very different forms but, in most cases, they are shaped like a luminous stick or point and are applied, set or glued onto the upper face of the dial, in accordance with the position of the hours.

To make luminous marks, one usually uses phosphorescent pigments, capable of being activated in day light and whose induced luminosity decreases sufficiently slowly to remain visible during the greater part of the night.

One also knows luminous pigments in which the luminosity is induced by a radioactive substance mixed with a luminescent substance. Use of these pigments is however prohibited or restricted in most countries because of their danger.

It is also known to add phosphorescent or luminous marks on a dial to obtain a particular aesthetic effect, for example to have a logo or an inscription appear. In this case, a layer of phosphorescent of luminescent material is applied onto the dial and it can, according to need, be covered with a coat of varnish or lacquer.

An inconvenience of this type of construction is that the marks made with luminous material remain visible also in daylight with an aesthetic effect that is not always appealing.

It is thus an aim of the present invention to propose a new dial that does not have the inconveniences of the prior art.

This aim is achieved by the dial having the characteristics of the main claim and notably by a dial comprising: a substrate plate; a semi-transparent layer covering at least part of said substrate plate with a material allowing light to pass; phosphorescent, fluorescent or luminescent elements lodged between said substrate plate and said semi-transparent layer; in which said luminous elements form a luminous image visible in darkness, but essentially invisible in normal lighting conditions.

BRIEF DESCRIPTION OF THE DRAWINGS

The present invention will be better understood by reading the description, the claims and the following figures, in which notably:

DETAILED DESCRIPTION OF THE INVENTION

Figure 1:
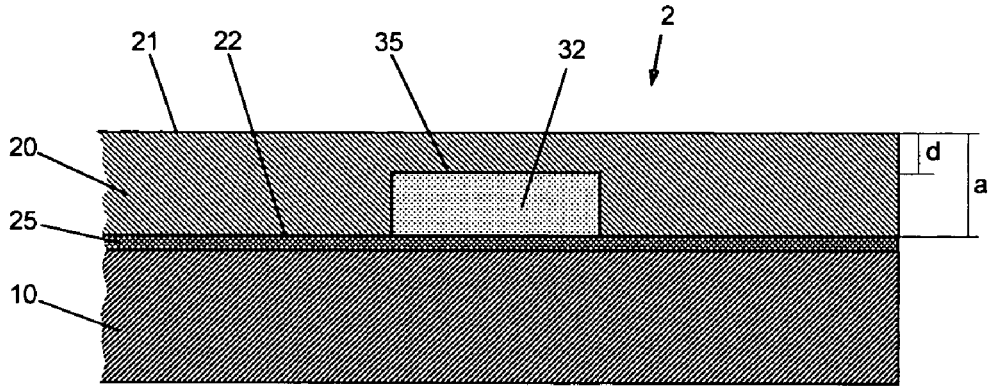
FIG. 1 shows a cross section view of a watch dial according to the invention.

The dial 2 represented in FIG. 1 comprises a substrate plate 10, generally made of brass or of another metal and designed to supply a mechanical support to the construction. The substrate plate 10 is completely or partially covered by a semi-transparent layer 20 chosen according to the aesthetic effect one wishes to achieve. In a preferred construction embodiment, the semi-transparent layer 20 is constituted of a sheet of natural mother-of-pearl of 0.4 mm thickness. It is however possible to use other semi-transparent or translucent materials, such as a coat of varnish, lacquer, stained or matted glass, acrylic resin or epoxy or any other semi-transparent plastic resin. The thickness of the semi-transparent layer 20 can also vary according to the effect sought and the material chosen.

For the construction of the dial 2, the substrate plate 10 and the semi-transparent layer 20 are first cut out, embossed, stamped or machined according to the desired shape and size. During this step, the holes 51 necessary for the wheels and staffs of the hands as well as the apertures 54 for the date indicator, if required, are made in the substrate plate 10 and in the semi-transparent layer 20.

On the rear side 22 of the semi-transparent layer 20, blind hollows 35 are made whose bottom is arranged in the direction of the visible side 21 of the semi-transparent layer 20. The hollows 35 are then filled with a phosphorescent pigment of the desired color. The present invention allows use of several phosphorescent, luminescent or fluorescent materials, but one will preferably use high-performance non-radioactive phosphorescent pigments, for example Super-LumiNova® pigments commercialized by LumiNova SA.

Once the hollows 35 are filled, a coat 25 of colored varnish is applied to the rear side 22 of the semi-transparent layer 20. The function of the coat 25 is to give a shade of color to the dial 2 and to seal the pigment 32 to protect it from humidity.

Figure 3:
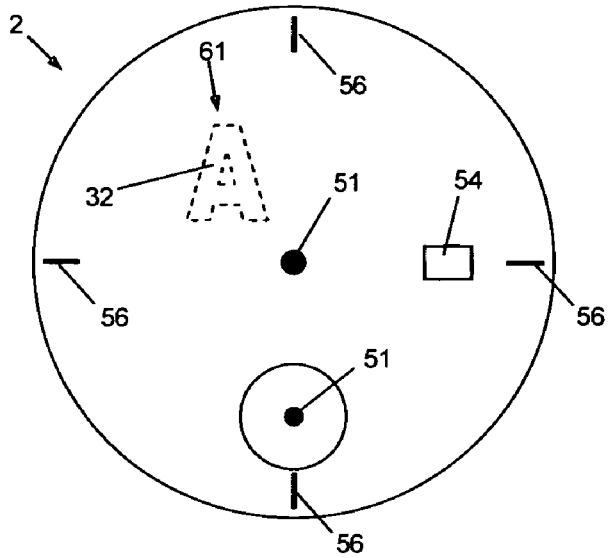
FIG. 3 represents a plane of a watch dial according to the invention.

The color of the coat of varnish 25 and that of the pigment 32 are chosen so as to blend in normal lighting conditions, when the intrinsic luminosity of the pigment 32 is too weak to be perceived. In darkness, the light generated by the pigment 32 shines through the layer 20 and allows the silhouette of the hollow 35 to be seen, as a luminous image 61 on an obscure background, as can be seen in FIG. 3.

Once application of the coat of varnish 25 has been completed, the semi-transparent layer 20 is fastened onto the substrate plate 10 to form the dial 2. In the subsequent manufacturing phases, the upper side 21 of the dial 2 is polished and optionally provided with indexes 56 and/or other functional or decorative elements that are applied, glued, riveted, serigraphed, transferred, painted or realized through any other method.

The luminous intensity of the image 61 depends on the thickness of the layer of pigment 32 and on the thickness d of semi-transparent matter 20 which the light emitted by the pigment 32 must pass through. It is consequently important that the hollows 35 be made with the greatest precision as any local variation of the thickness d will result in a considerable variation of luminous intensity because of the considerable absorption of light by the mother-of-pearl or the semi-transparent material. According to the manufacturing requirements and to the chosen material, the hollows 35 can be made by machining or selective chemical attack or by any other method.

Figure 2:
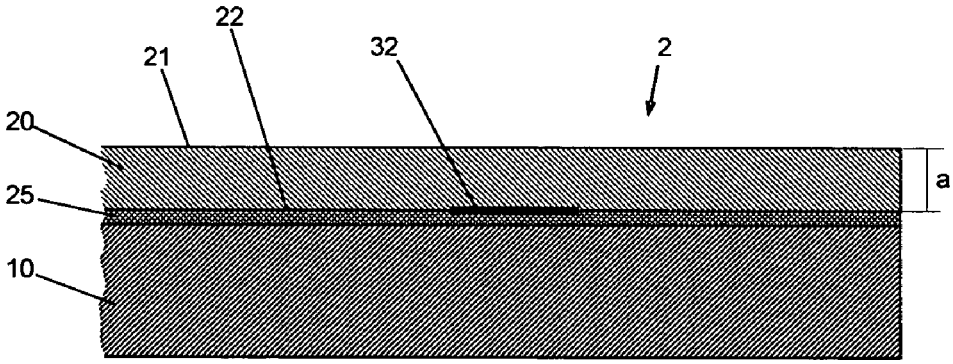
FIG. 2 shows a cross section view of a watch dial according to a second embodiment of the invention.

In another embodiment of the inventive dial, represented in FIG. 2, a layer of luminescent pigment 32 is applied by serigraphy, tampography, manually or by any other application method on the rear side 22 of the semi-transparent layer 20 and then covered by the protective layer 25. This embodiment is very well suited to dials in which the thickness of the semi-transparent layer 20 is particularly thin.

In a later embodiment of the inventive dial, also adapted to thin semi-transparent layers 20, the blind hollows 35 are open in the substrate plate 10 and filled with the luminescent pigment 32. The coat of colored varnish 25 can in this case be applied to the rear side 22 of the semi-transparent 20 or to the substrate plate 10.

The invention claimed is:

1. A dial, comprising:

a substrate plate;

a semi-transparent layer covering at least part of said substrate plate of a material allowing light to pass;

phosphorescent, fluorescent or luminescent luminous elements lodged in hollows made in said semi-transparent layer and open towards said substrate plate, said luminous elements forming an image that is visible in darkness;

wherein the semi-transparent layer is visible under normal lighting conditions and has a configuration that does not form an image, such that the hollows and the image of said luminous elements are not visible under normal lighting conditions.

2. The dial of claim 1 wherein said luminous elements are applied by serigraphy, tampography or manually onto said substrate plate and/or onto said semi-transparent layer.

3. The dial of claim 1 wherein said semi-transparent layer is made of one of the following materials: mother-of-pearl; varnish; lacquer; glass; plastic.

4. The dial of claim 1 comprising a colored layer interposed between said substrate plate and said semi-transparent layer.

5. The dial of claim 4 wherein said colored layer is a coat of varnish.

6. The dial of claim 1 wherein said blind hollows are made by machining or by selective chemical attack.

7. The dial of claim 1, wherein said semi-transparent layer and said luminous elements do not form any image that is visible under normal lighting conditions.

8. A watch piece, comprising a dial, said dial comprising:

a substrate plate;

a semi-transparent layer covering at least part of said substrate plate of a material allowing light to pass;

phosphorescent, fluorescent or luminescent luminous elements lodged between said substrate plate and said semi-transparent layer to form an image that is visible in darkness; and wherein said luminous elements are lodged in blind hollows made in said semi-transparent layer and open towards said substrate plate;

wherein the semi-transparent layer is visible under normal lighting conditions and has a configuration that does not form an image, such that the hollows and said luminous elements are not visible under normal lighting conditions.

9. The dial of claim 8 wherein said blind hollows are made by machining or by selective chemical attack.

10. The dial of claim 8, wherein said semi-transparent layer and said luminous elements do not form any image that is visible under normal lighting conditions.

11. A dial consisting of:

a substrate plate;

a continuous semi-transparent layer covering at least part of said substrate plate of a material allowing light to pass, the semi-transparent layer having at least one marking visible under normal lighting conditions;

phosphorescent, fluorescent or luminescent luminous elements lodged between said substrate plate and said semi-transparent layer, and wherein said luminous elements are lodged in blind hollows made in said semi-transparent layer and open towards said substrate plate;

wherein said luminous elements form an image that is visible in darkness, the semi-transparent layer is visible under normal lighting conditions and has a configuration that does not form an image, such that the hollows and said luminous elements are not visible under normal lighting conditions.

12. The dial of claim 11 wherein said luminous elements are applied by serigraphy, tampography or manually onto said substrate plate and/or onto said semi-transparent layer.

13. The dial of claim 11 wherein said semi-transparent layer is made of one of the following materials: mother-of-pearl; varnish; lacquer; glass; plastic.

14. The dial of claim 11 wherein said blind hollows are made by machining or by selective chemical attack.

15. A method comprising:

providing a dial having a substrate plate and a semi-transparent layer covering at least part of said substrate plate of a material allowing light to pass, lodging phosphorescent, fluorescent or luminescent luminous elements in hollows made in said semi-transparent layer and open towards said substrate plate, forming with said luminous elements an image that is visible in darkness, and hiding the image of said hollows and said luminous elements in normal lighting conditions by the semi-transparent layer, wherein the semi-transparent layer is configured to not form an image.

16. A dial consisting of:

a substrate plate;

a continuous semi-transparent layer covering at least part of said substrate plate of a material allowing light to pass, the semi-transparent layer having at least one marking visible under normal lighting conditions;

phosphorescent, fluorescent or luminescent luminous elements lodged between said substrate plate and said semi-transparent layer, and wherein said luminous elements are lodge in blind hollows made in said semi-transparent layer and open towards said substrate plate; and, a colored layer interposed between said substrate plate and said semi-transparent layer;

wherein said luminous elements form an image that is visible in darkness, the semi-transparent layer is visible under normal lighting conditions and has a configuration that does not form an image, such that the hollows and said luminous elements are not visible under normal lighting conditions.

17. The dial of claim 16 wherein said luminous elements are applied by serigraphy, tampography or manually onto said substrate plate and/or onto said semi-transparent layer.

18. The dial of claim 16 wherein said semi-transparent layer is made of one of the following materials: mother-of-pearl; varnish; lacquer; glass; plastic.

19. The dial of claim 16 wherein said colored layer is a coat of varnish.

20. The dial of claim 16 wherein said blind hollows are made by machining or by selective chemical attack.

* * * * *